US009117620B2

(12) United States Patent
Akutsu et al.

(10) Patent No.: US 9,117,620 B2
(45) Date of Patent: Aug. 25, 2015

(54) MAGNETRON AND APPARATUS THAT USES MICROWAVES

(75) Inventors: Kazuyasu Akutsu, Tochigi (JP); Nagisa Kuwahara, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 580 days.

(21) Appl. No.: 13/512,806

(22) PCT Filed: Nov. 30, 2010

(86) PCT No.: PCT/JP2010/006989

§ 371 (c)(1),
(2), (4) Date: Oct. 2, 2012

(87) PCT Pub. No.: WO2011/065030

PCT Pub. Date: Jun. 3, 2011

(65) Prior Publication Data

US 2013/0015182 A1 Jan. 17, 2013

(30) Foreign Application Priority Data

Nov. 30, 2009 (JP) ..... 2009-272337

(51) Int. Cl.
*H05B 6/72* (2006.01)
*H01J 25/50* (2006.01)
*H01J 23/00* (2006.01)

(52) U.S. Cl.
CPC ..... *H01J 25/50* (2013.01); *H01J 23/005* (2013.01)

(58) Field of Classification Search
CPC ..... H01J 23/00–23/05; H01J 25/00–25/78
USPC ..... 219/678–763; 315/39.51
See application file for complete search history.

(56) References Cited

U.S. PATENT DOCUMENTS 4,298,825 A 11/1981 Daikoku et al.
5,604,405 A * 2/1997 Ogura ..... 315/39.51
2006/0049766 A1 * 3/2006 Lee et al. ..... 315/39.51

FOREIGN PATENT DOCUMENTS

JP 56-138850 A 10/1981
JP 61-032331 A 2/1986
JP 61-243639 A 10/1986
JP 64-084545 A 3/1989

(Continued)

OTHER PUBLICATIONS

International Search Report for International Application No. PCT/JP2010/006989, dated Jan. 18, 2011, 2 pages.

(Continued)

*Primary Examiner* — Sang Y Paik
(74) *Attorney, Agent, or Firm* — Brinks Gilson & Lione

(57) ABSTRACT

A magnetron includes: an anode tube; and cooling fins placed on a periphery of the anode tube and arranged along a central axis of the anode tube. Each of the cooling fins includes at least two sets of fins formed by cutting a part of the cooling fin, and performing different bending works on the cut portions, respectively, so as to form a region where the cooling fins are dense and a region where the cooling fins are sparse, when viewed in a flowing direction of a cooling medium which cools the anode tube through the cooling fins. The at least two sets of fins are bent at bending angles such that intervals of the cooling fins in the region where the cooling fins are dense are ½ or less of placement intervals of the cooling fins.

7 Claims, 6 Drawing Sheets

(56) References Cited

FOREIGN PATENT DOCUMENTS

| | | | |
|---|---|---|---|
| JP | 03-184234 | A | 8/1991 |
| JP | 08-138562 | A | 5/1996 |
| JP | 11-007898 | A | 1/1999 |
| JP | 2006-073519 | A | 3/2006 |

OTHER PUBLICATIONS

Extended European Search Report in corresponding European Application No. 10832879.0, dated Jun. 20, 2014, 5 pages.

* cited by examiner

MAGNETRON AND APPARATUS THAT USES MICROWAVES

This application is a 371 application of PCT/JP2010/006989 having an international filing date of Nov. 30, 2010, which claims priority to JP2009-272337 filed Nov. 30, 2009, the entire contents of which are incorporated herein by reference.

TECHNICAL FIELD

The present invention relates to a magnetron and an apparatus that uses microwaves, and more particularly to a magnetron which is to be used in an apparatus that uses microwaves, such as a microwave oven.

BACKGROUND ART

In a conventional magnetron 100 disclosed in Patent Document 1, as shown in FIG. 6, cooling fins 105 extending from fin plates 104 that are attached at predetermined intervals to an anode tube 102 in which permanent magnets 101 are disposed at the ends thereof are evenly placed over the whole region R (in FIG. 6, the broken-line frame), thereby improving the heat dissipation efficiency of the cooling fins 105.

RELATED ART DOCUMENTS

Patent Documents

Patent Document 1: JP-A-61-32331

SUMMARY OF THE INVENTION

Problem to be Solved by the Invention

In the case where cooling fins are configured by a plurality of fins having the same shape, when the number of fins constituting the cooling fins is simply increased in order to reduce the temperature of a magnetron, however, the gaps between the plurality of fins constituting the cooling fins are narrowed. In the magnetron 100 of Patent Document 1, when the cooling fins 105 are evenly placed in the region R through which the cooling air passes, particularly, gaps S in a yoke 103 are reduced, and the air resistance is increased. Therefore, the amount of cooling air which passes between the fins 105 is reduced, and the heat dissipation efficiency of the cooling fins 105 is lowered (see FIG. 1 of Patent Document 1).

An object of the invention is to provide a magnetron and apparatus that uses microwaves which can improve cooling efficiency by forming a region where cooling fins are sparse and a region where cooling fins are dense when the cooling fins are viewed in a flowing direction of a cooling medium of the magnetron.

Means for Solving the Problem

The present invention provides a magnetron including: an anode tube in which permanent magnets are disposed at both ends thereof; and a plurality of cooling fins which are placed on a periphery of the anode tube, and which are arranged along a central axis of the anode tube, wherein each of the plurality of cooling fins includes at least two sets of fins which are formed by cutting a part of the cooling fin, and performing different bending works on the cut portions, respectively, so as to form a region where the cooling fins are dense and a region where the cooling fins are sparse, when viewed in a flowing direction of a cooling medium which cools the anode tube through the plurality of cooling fins, and wherein the at least two sets of fins are bent at bending angles such that intervals of the cooling fins in the region where the cooling fins are dense are ½ or less of placement intervals of the cooling fins.

In the magnetron described above, when viewed in the flowing direction of the cooling medium which cools the anode tube through the plurality of cooling fins, in the region where the cooling fins are sparse, the fin of one of the at least two sets of fins and a part of the fin of another set are placed on a same plane.

In the magnetron described above, when viewed in the flowing direction of the cooling medium which cools the anode tube through the plurality of cooling fins, in the region where the cooling fins are dense, a direction of the bending work on the fin of the one of the at least two sets of fins is different from a direction of the bending work on the fins of another set.

Further, the present invention provides an apparatus that uses microwaves including the magnetron described above.

Advantages of the Invention

The magnetron and the apparatus that uses microwaves of the invention can improve cooling efficiency of a magnetron by forming a region where cooling fins are sparse and a region where cooling fins are dense when the cooling fins are viewed in a flowing direction of a cooling medium of the magnetron.

MODE FOR CARRYING OUT THE INVENTION

Hereinafter, an embodiment of the invention will be described with reference to the drawings.

Figure 1:
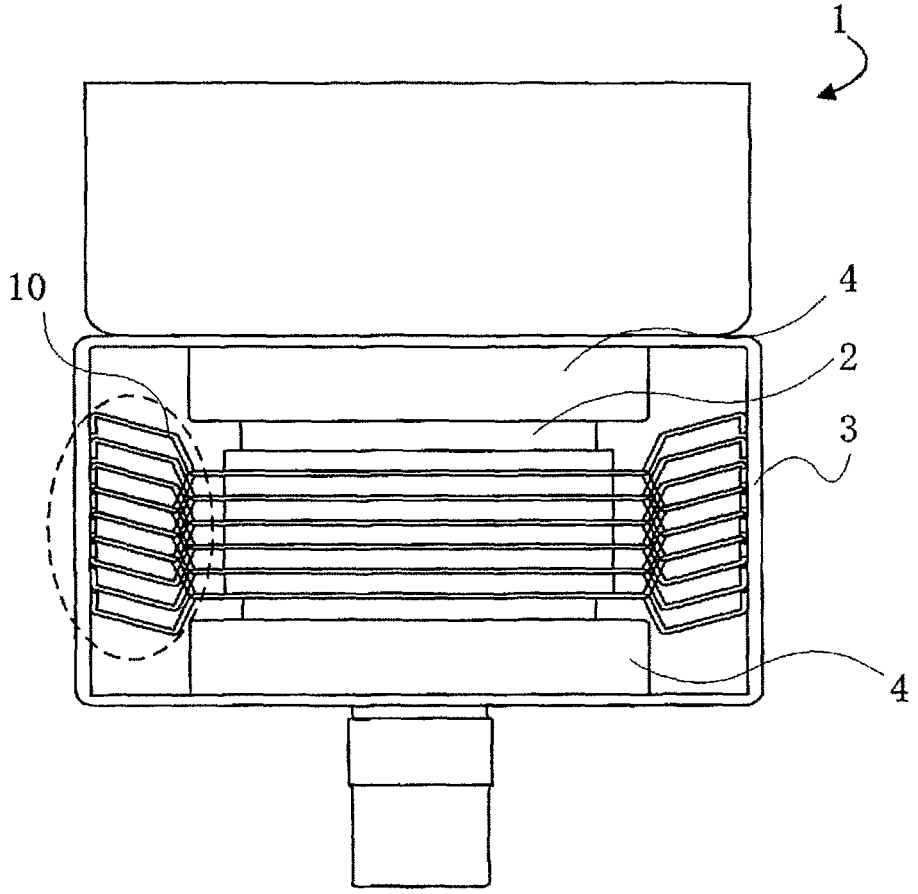
FIG. 1 is a view of the whole configuration of a magnetron 1 of an embodiment of the invention.

Referring to FIG. 1, the configuration of a magnetron 1 of the embodiment of the invention will be described. FIG. 1 is a view of the whole configuration of the magnetron 1 of the embodiment of the invention. The magnetron 1 of the embodiment has: an anode tube 2 which has permanent magnets 4 at the ends in the longitudinal axis direction; a plurality of cooling fins 10 which are placed on the periphery of the anode tube 2 at substantially regular intervals along the longitudinal direction of the anode tube 2; and a magnetic yoke 3 in which the plurality of permanent magnets 4, the anode tube 2, and the plurality of cooling fins 10 are disposed. The cooling fins 10 have a function of cooling the magnetron 1 which is heated to a high temperature during operation. The magnetron 1 of the embodiment of the invention can be used in an apparatus that uses microwaves, such as a microwave oven.

Figure 2A:
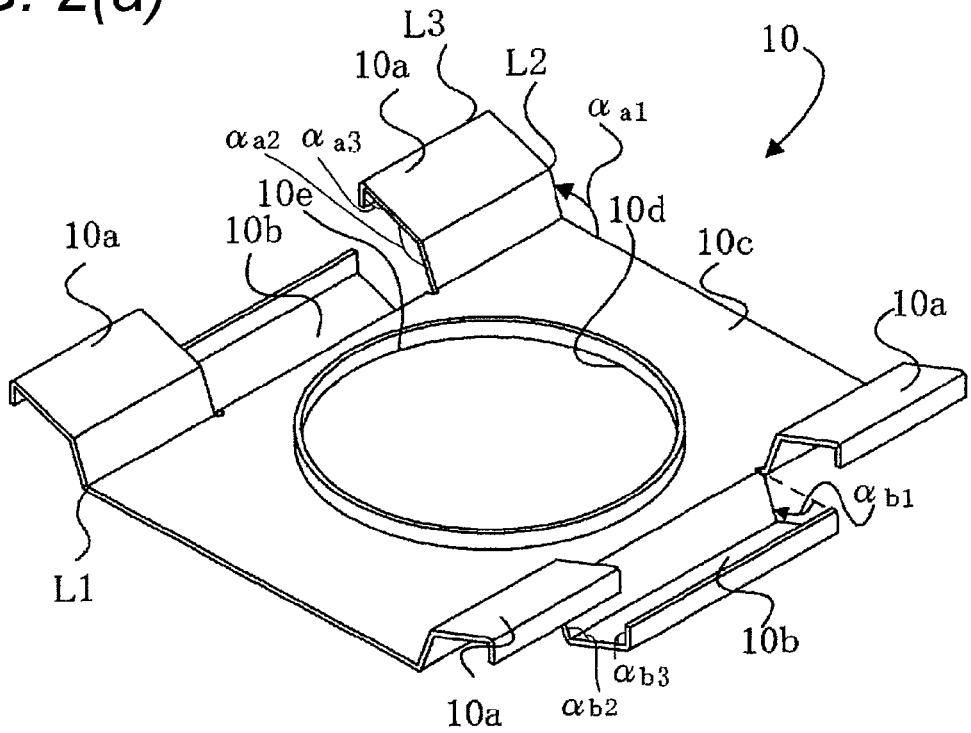
FIG. 2(*a*) is a perspective view of a cooling fin 10 after a bending work, and FIG. 2(*b*) is a plan view of the cooling fin 10 before the bending work.
Figure 2B:
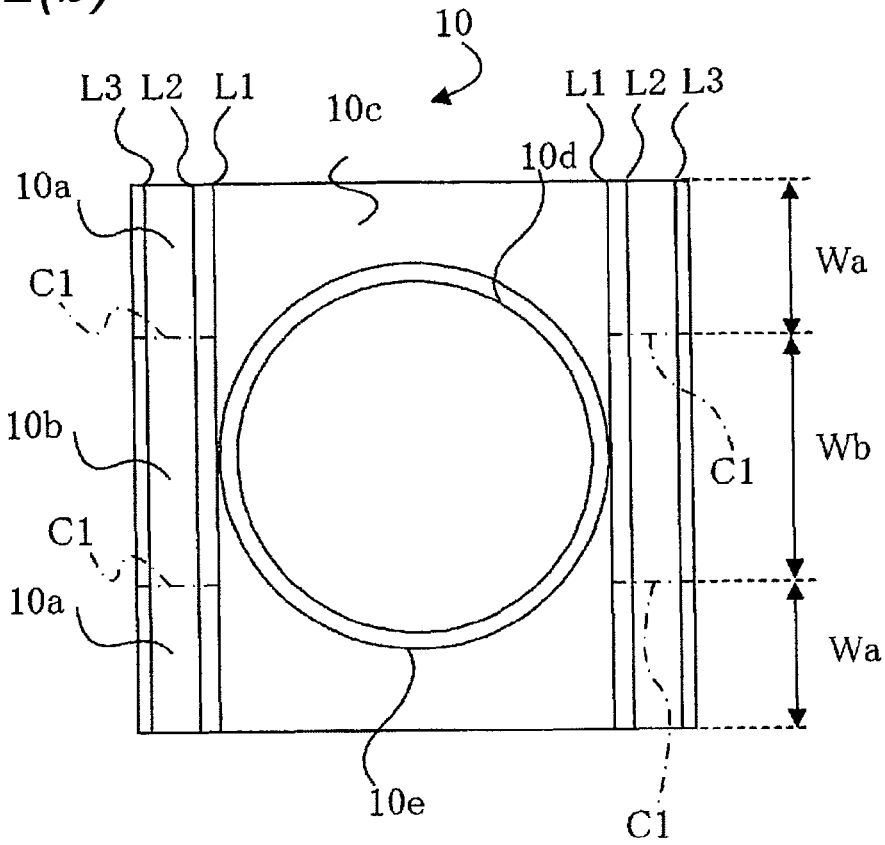

Next, the configuration of the cooling fins 10 will be described with reference to FIG. 2(*a*) and FIG. 2(*b*). FIG. 2(*a*) is a perspective view of one cooling fin 10 (after a bending work). FIG. 2(*b*) is a plan view of one cooling fin 10 (before the bending work). In the magnetron 1 of the embodiment, six cooling fins 10 are placed at regular intervals along the longitudinal direction of the anode tube 2.

The cooling fin 10 shown in FIG. 2(*a*) is a thin aluminum plate, and configured by: a body portion 10*c* in which the anode tube 2 is inserted through a hole 10*d* disposed inside of it; a cylindrical portion 10*e* which is disposed along the hole 10*d* of the body portion 10*c*; and a plurality of fins 10*a*, 10*b* which are formed by forming cuts in a part of the body portion 10*c*. The plurality of fins 10*a*, 10*b* constitute a part of the body portion 10*c*, and, as shown in FIG. 2(*a*), one cooling fin 10 is formed by forming parallel cuts extending a predetermined distance from a pair of sides of the cooling fin 10, and applying a bending work to a plurality of places in portions where the cuts are formed. In the magnetron 1 of the embodiment, the plurality of fins 10*a*, 10*b* which are formed in one cooling fin 10 are bent by different bending works. In the whole magnetron 1 of the embodiment, therefore, each of the six cooling fins 10 is configured by two sets of fins which are bent by different bending works.

The bending works which are applied respectively to the plurality of fins 10*a*, 10*b* will be described with reference to FIGS. 2(*a*) and 2(*b*). FIG. 2(*b*) is a plan view of one cooling fin 10 before the bending work. An cutting work is performed on one side of the cooling fin 10 along cut lines C1 of FIG. 2(*b*), and division into four fins 10*a* having a width Wa, and two fins 10*b* having a width Wb is performed. The widths Wa, Wb of the plurality of fins 10*a*, 10*b* are arbitrary. Different bending works are performed on the four fins 10*a* belonging to one set, and the two fins 10*b* belonging to the other set along bending lines L1, L2, L3, respectively.

Figure 3:
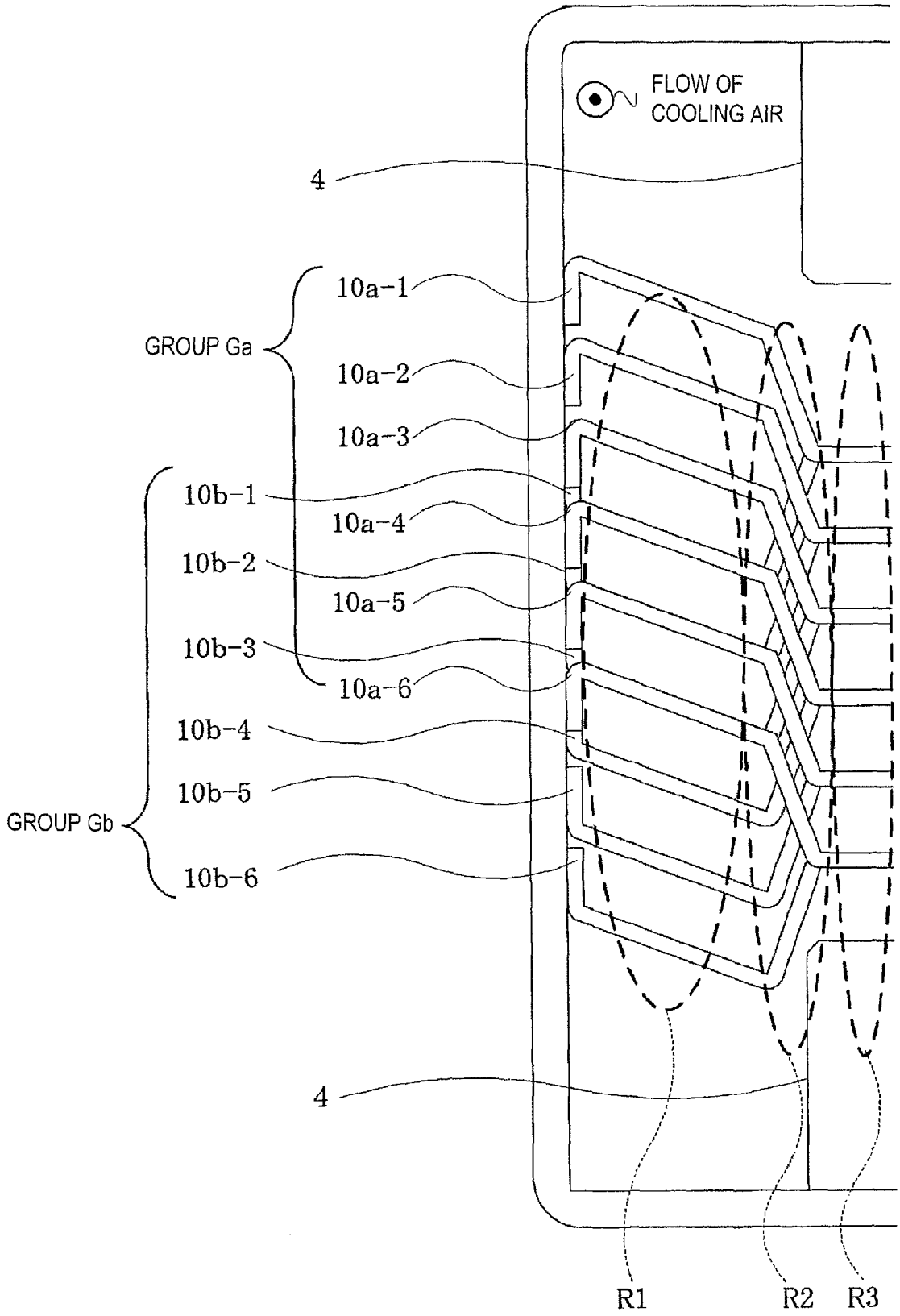
FIG. 3 is an enlarged view of main portions of the magnetron 1.

Here, the magnetron 1 of the embodiment has one feature that, in the case where the bending directions (obliquely upward or obliquely downward) and angles ($\alpha_{a1}$, $\alpha_{b1}$) of the bendings of the plurality of fins 10*a*, 10*b* along the bending lines L1 are adequately set, when the cooling fins 10 are attached to the anode tube 2 and the cooling fins 10 are viewed in the flowing direction of a cooling medium (in the embodiment, air) of the magnetron 1, division into a region where the plurality of fins 10*a*, 10*b* are dense, and that where the plurality of fins 10*a*, 10*b* are sparse is performed (see FIG. 3).

In the bending lines L1, the four fins 10*a* belonging to the one set are bent at the predetermined angle $\alpha_{a1}$, toward an obliquely upward direction (in FIG. 2(*b*), the direction from the depth side of the sheet to the front side). In the bending lines L2, then, parts of the fins 10*a* in the ranges from the bending line L2 to the bending line L3 are bent at a predetermined angle $\alpha_{a2}$, toward an obliquely downward direction (in FIG. 2(*b*), the direction from the front side of the sheet to the depth side). The predetermined angle $\alpha_{a2}$ is set so that, when the cooling fin 10 is viewed in the flowing direction of the cooling medium (in the embodiment, air) of the magnetron 1, parts of the fins 10*a* in the ranges from the bending lines L2 to the bending lines L3, and those of the fins 10*b* in the ranges from the bending lines L2 to the bending lines L3 are overlap with one another (in FIG. 3, see a region R1). In the bending lines L3, then, the fins are bent at a predetermined angle $\alpha_{a3}$, toward an obliquely downward direction (in FIG. 2(*b*), the direction from the front side of the sheet to the depth side).

In the bending lines L1, the two fins 10*b* belonging to the other set are bent at the predetermined angle $\alpha_{b1}$, toward an obliquely downward direction (in FIG. 2(*b*), the direction from the front side of the sheet to the depth side). In the bending lines L2, then, parts of the fins 10*b* in the ranges from the bending line L2 to the bending line L3 are bent at a predetermined angle $\alpha_{b2}$, toward an obliquely upward direction (in FIG. 2(*b*), the direction from the depth side of the sheet to the front side). The predetermined angle $\alpha_{b2}$ is set so that parts of the fins 10*a* in the ranges from the bending lines L2 to the bending lines L3, and those of the fins 10*b* in the ranges from the bending lines L2 to the bending lines L3 are overlap with one another (in FIG. 3, see the region R1). In the bending lines L3, then, the fins are bent at a predetermined angle $\alpha_{b3}$, toward an obliquely upward direction (in FIG. 2(*b*), the direction from the depth side of the sheet to the front side) so as to extend along the magnetic yoke 3.

Then, six cooling fins 10 which are bent in the above-described method are prepared, and the cooling fins 10 are attached to the anode tube 2 so that the anode tube 2 is inserted into the holes 10*d*. As shown in FIG. 1, at this time, end portions of the six cooling fins 10 which are bent in the bending lines L3 at the predetermined angle are fixed in a state where the end portions are pressed against the inside of the magnetic yoke 3.

Next, the conditions of the plurality of fins 10*a*, 10*b* when the cooling fins 10 are attached to the anode tube 2 and the cooling fins 10 are viewed in the flowing direction of the cooling medium (in the embodiment, air) of the magnetron 1 will be described with reference to FIG. 3. FIG. 3 is an enlarged view of main portions of the magnetron 1. In FIG. 3, for the sake of description, the cooling fins 10 in the left half of FIG. 1 will be described. In FIG. 3, the fins 10*a* overlap with one another in the depth direction, and fins 10*a* which cannot be seen due to overlapping are not illustrated. In the figure, it is assumed that the cooling medium flows in the direction from the front side of the sheet to the depth side. For the sake of description, in order to distinguish each of the fins 10*a*, 10*b* of the six cooling fins 10, the fins 10*a* are denoted in FIG. 3 as the fins 10*a*-1, . . . , 10*a*-6 starting from the top. Similarly, the fins 10*b* are denoted in FIG. 3 as the fins 10*b*-1, . . . , 10*b*-6 starting from the top.

As shown in FIG. 3, when the cooling fins 10 attached to the anode tube 2 are viewed in the flowing direction of the cooling medium of the magnetron 1, portions in which the fins 10*a*-1, . . . , 10*a*-6 constituting a group Ga are bent toward an obliquely upward direction at the predetermined angle $\alpha_{a1}$, and the fins 10*b*-1, . . . , 10*b*-6 constituting a group Gb are bent toward an obliquely downward direction at the predetermined angle $\alpha_{b1}$ are dense in a region R2 shown in FIG. 3.

Figure 4:
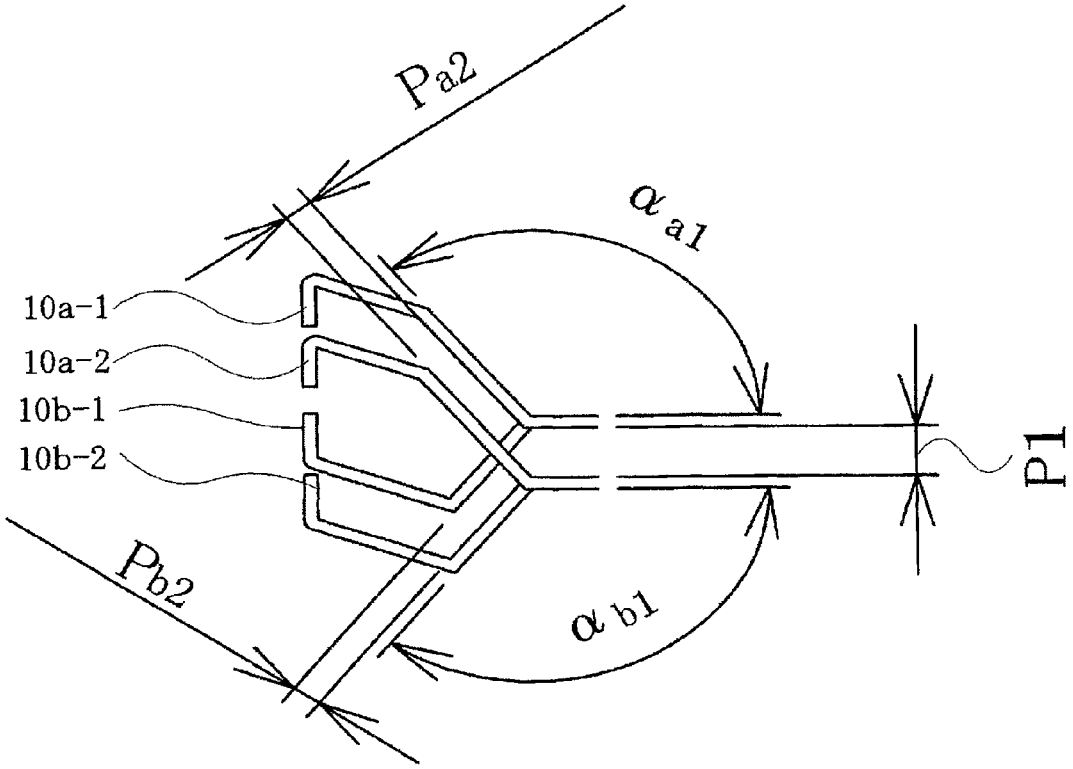
FIG. 4 is a view illustrating placement intervals of cooling fins 10.

The angles of the bendings of the cooling fins 10 shown in FIG. 3 will be described with reference to FIG. 4. FIG. 4 is a view illustrating placement intervals of the cooling fins 10. In FIG. 4, for the sake of description, only the fins 10*a*-1, 10*a*-2, 10*b*-1, 10*b*-2 which are shown in FIG. 3 are shown.

In the magnetron 1 of the embodiment, as shown in FIG. 4, the bending angles $\alpha_{a1}$, $\alpha_{b1}$ at which the plurality of fins 10*a*, 10*b* are bent in the bending lines L1 are set to, for example, 114°. In the magnetron 1 of the embodiment, the interval P1 between cooling fins 10 which are placed along the longitudinal direction of the anode tube 2, and which are adjacent to each other is set to 3 mm, and, in cooling fins 10 which are adjacent to each other along the longitudinal direction of the anode tube 2, the interval Pa2 between the fin 10*a*-1 of one cooling fin and the fin 10*a*-2 of the other cooling fin is set to one half of the interval P1 or 1.5 mm. Similarly, the interval Pb2 between the fin 10*b*-1 and the fin 10*b*-2 is set to a half of the interval P1 or 1.5 mm. As shown in FIG. 3, therefore, it is possible to form a region where the plurality of fins 10*a*, 10*b* are dense.

In the magnetron 1 of the embodiment, here, the bending angles $\alpha_{a1}$, $\alpha_{b1}$ are set to 114°. However, the angles are not limited to this value. When the bending angles $\alpha_{a1}$, $\alpha_{b1}$ are set in the range from 101° to 127°, a region where the plurality of fins 10*a*, 10*b* are dense can be formed in the region R2 as shown in FIG. 3. In the magnetron 1 of the embodiment, moreover, the intervals Pa2, Pb2 (see FIG. 4) of the fins which are adjacent to each other along the longitudinal direction of the anode tube 2 are set to 1.5 mm. However, the intervals are not limited to this value. When the intervals Pa2, Pb2 are set to one half or less of the interval P1, a region where the plurality of fins 10*a*, 10*b* are dense can be formed in the region R2 as shown in FIG. 3.

When the cooling fins 10 attached to the anode tube 2 are viewed in the flowing direction of the cooling medium of the magnetron 1, the portions in which the fins 10*a*-1, . . . , 10*a*-6 constituting the group Ga are bent toward an obliquely upward direction at the predetermined angle $\alpha_{a2}$, and the fins 10*b*-1, . . . , 10*b*-6 constituting the group Gb are bent toward an obliquely downward direction at the predetermined angle $\alpha_{b2}$ are uncrowded or sparse in the region R1 shown in FIG. 3. In the region R1 shown in FIG. 3, the intervals of the plurality of fins 10*a*, 10*b* constituting the cooling fins 10 are wide, and, when the cooling fins 10 attached to the anode tube 2 are viewed in the flowing direction of the cooling medium of the magnetron 1, 10*a*-4, 10*a*-5, and 10*a*-6 in the fins constituting the group Ga, and 10*b*-1, 10*b*-2, and 10*b*-3 in the fins constituting the group Gb are placed on a substantially same plane. In the region R1 shown in FIG. 3, therefore, the effective area of the portion where the gaps of the plurality of fins 10*a*, 10*b* constituting the cooling fins 10 are wide is increased, and the airflow resistance difference with respect to a space portion surrounding the permanent magnets 4 can be reduced. Therefore, the amount of the cooling medium (in the embodiment, air) which passes between the cooling fins 10 is increased, and the cooling efficiency of the magnetron 1 is improved.

Similarly with the region R1 shown in FIG. 3, in a region R3 in which a bending work is not performed, and which is a region in the vicinity of the anode tube 2, the fins 10*a*-1, . . . , 10*a*-6 constituting the group Ga, and the fins 10*b*-1, . . . , 10*b*-6 constituting the group Gb are uncrowded or sparse.

In the magnetron 1 of the embodiment, therefore, regions where the plurality of fins 10*a*, 10*b* are sparse and dense when the cooling fins 10 attached to the anode tube 2 are viewed in the flowing direction of the cooling medium of the magnetron 1 can be formed economically and easily simply by using the plurality of cooling fins 10 having the same shape, and performing the cutting and bending works on each cooling fin 10.

Figure 5:
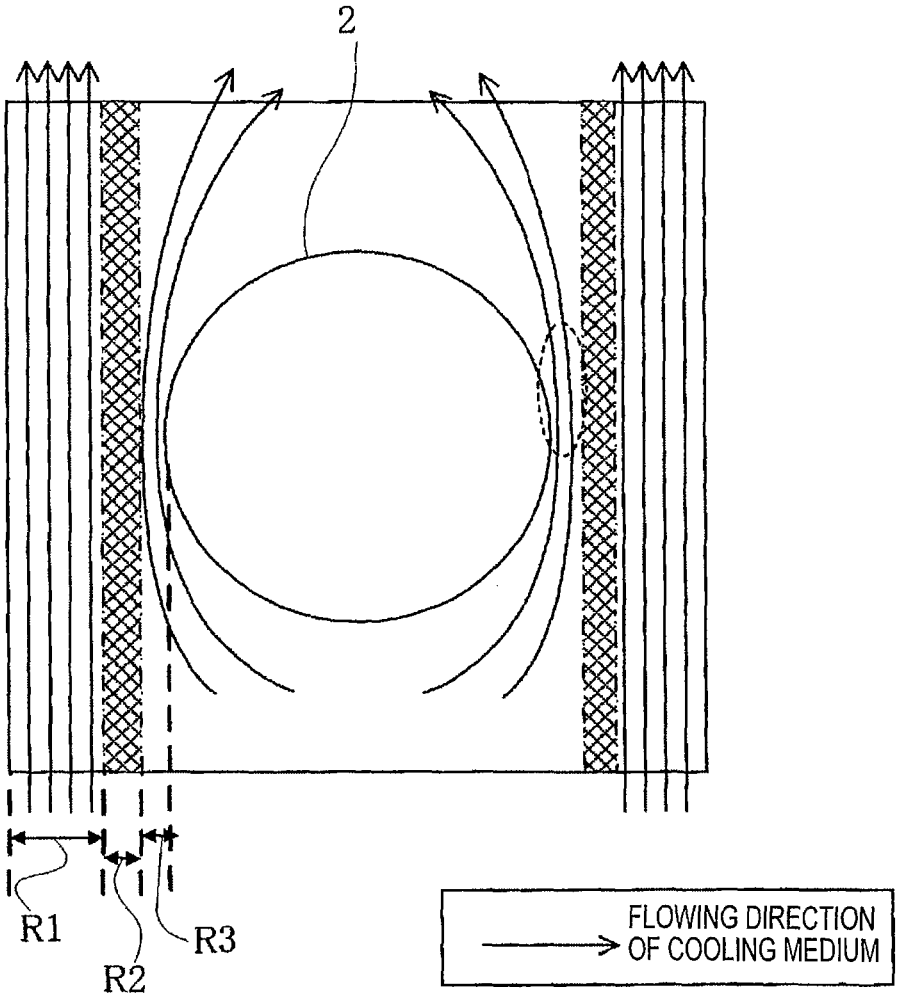
FIG. 5 is a view schematically showing the flow of a cooling medium which flows between the cooling fins 10.
Figure 6:
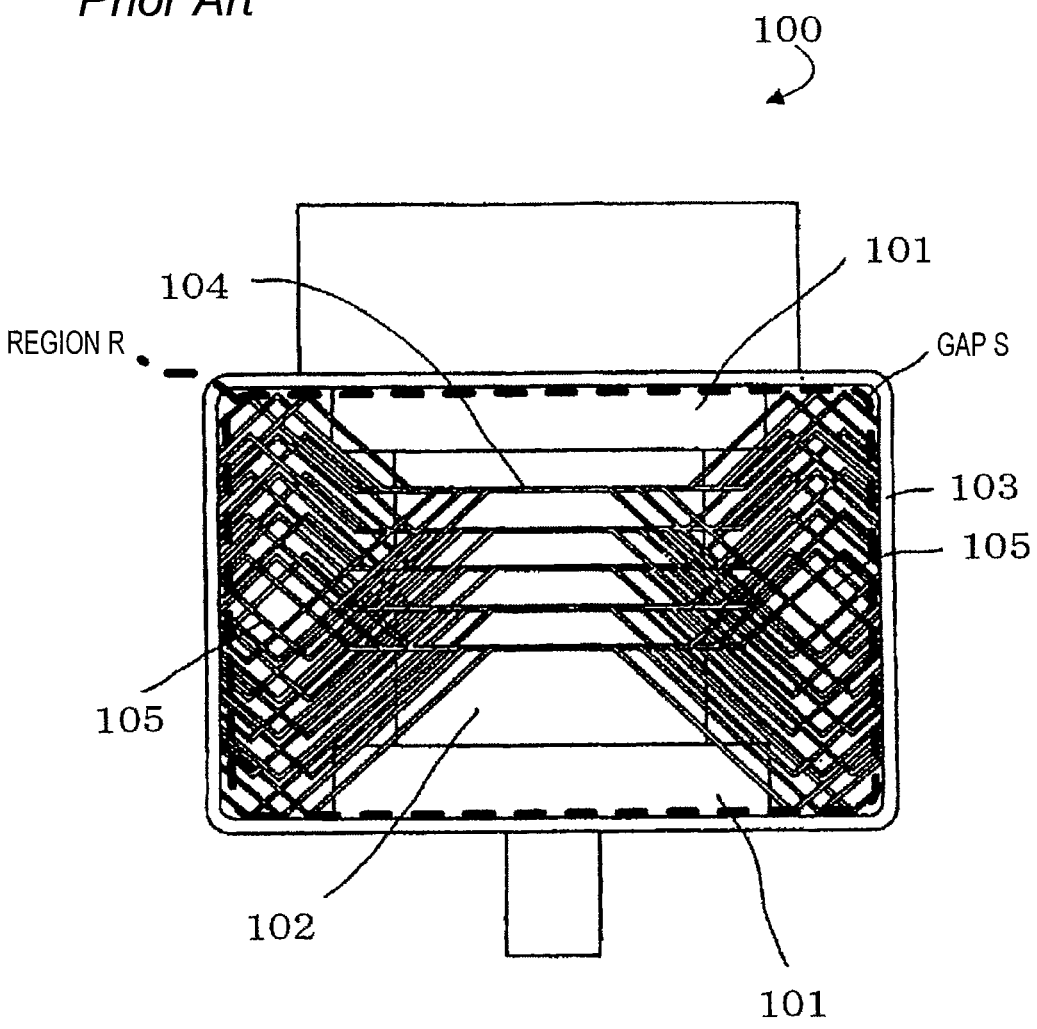
FIG. 6 Prior Art
FIG. 6 is a view of the whole configuration of a conventional magnetron 100.

Next, the flow of the cooling medium (air) which passes through gaps between the cooling fins 10 in the magnetron 1 of the embodiment will be described with reference to FIG. 5. FIG. 5 is a view schematically showing the flow (in the figure, the arrows) of the cooling medium (air) which passes through gaps between the cooling fins 10. As shown in FIG. 5, for the cooling medium (air), the region R2 (in FIG. 5, the hatched portions) where the fins 10*a*-1, . . . , 10*a*-6 constituting the group Ga and the fins 10*b*-1, . . . , 10*b*-6 constituting the group Gb are crowded can be deemed as a barrier which impedes the flow of the cooling medium (air). Therefore, the cooling medium (air) which passes through the region R3 impinges on the region R2 which can be deemed as a barrier, and then flows to the rear side of the anode tube 2.

In the magnetron 1 of the embodiment, therefore, the regions where the plurality of fins 10*a*, 10*b* are sparse and dense when the cooling fins 10 attached to the anode tube 2 are viewed in the flowing direction of the cooling medium of the magnetron 1 are formed, whereby the reduction of the amount of the cooling medium which passes between the plurality of fins 10*a*, 10*b* can be suppressed as a whole, and the cooling efficiency of the magnetron 1 can be improved. In the magnetron 1 of the embodiment, furthermore, a diffusion phenomenon that the cooling medium which passes through the region R3 escapes from the anode tube 2 can be prevented from occurring by the region R2 which can be deemed as a barrier. Therefore, the cooling efficiency of the magnetron 1 can be further improved.

In the magnetron 1 of the embodiment, as described above, simply by adequately bending at least two places of the plurality of fins 10*a*, 10*b* constituting the cooling fins 10 having the same shape, the plurality of fins 10*a*, 10*b* are caused to be dense in the region R2 shown in FIG. 3, but to be sparse in the regions R1, R3 shown in FIG. 3 when the cooling fins 10 attached to the anode tube 2 are viewed in the flowing direction of the cooling medium of the magnetron 1. When the portion (in FIG. 3, the region R2) where the gaps between the fins of the plurality of fins 10*a*, 10*b* constituting the cooling fins 10 are extremely small is disposed, therefore, the portion (in FIG. 3, the regions R1, R3) where the gaps between the fins of the plurality of fins 10*a*, 10*b* constituting the cooling fins 10 are wide is ensured, whereby the effective area of the portion where the gaps between the plurality of fins 10*a*, 10*b* constituting the cooling fins 10 are wide is increased, and the airflow resistance difference with respect to the space portion surrounding the permanent magnets 4 can be reduced. Therefore, the amount of the reduction of the cooling medium (in the embodiment, air) which passes between the cooling fins 10 is suppressed, and the cooling efficiency of the magnetron 1 is improved.

In the magnetron 1 of the embodiment, with respect to the portion (in FIG. 3, the region R1) where the intervals of the plurality of fins 10*a*, 10*b* constituting the cooling fins 10 are wide when the magnetron 1 is viewed in the flowing direction of the cooling medium (in the embodiment, air), fins in which a group (the group Ga) in which upward bending is performed in the region R2 shown in FIG. 3, and a group (the group Gb) in which downward bending is performed in the region R2 shown in FIG. 3 are on a substantially same plane are disposed, whereby the effective area of the portion where the gaps between the plurality of fins 10*a*, 10*b* constituting the cooling fins 10 are wide is increased, and the airflow resistance difference with respect to the space portion surrounding the permanent magnets 4 can be reduced. Therefore, the reduction of the amount of the cooling medium (in the embodiment, air) which passes between the cooling fins 10 is suppressed, and the cooling efficiency of the magnetron 1 is improved.

In the magnetron 1 of the embodiment, moreover, the cooling medium (air) which passes through the region R3 impinges on the region R2 which can be deemed as a barrier, and then flows to the rear side of the anode tube 2. Therefore, the cooling efficiency of the magnetron 1 can be further improved.

In the magnetron 1 of the embodiment, it has been described that the cooling fins 10 are thin aluminum plates. However, the invention is not limited to this.

Although various embodiments of the invention have been described, the invention is not limited to the matters disclosed in the above-described embodiment. In the invention, it is expected that those skilled in the art will change or apply the matters based on the description in the description and the well-known technique, and such a change or application is included in the range to be protected.

The application is based on Japanese Patent Application (No. 2009-272337) filed Nov. 30, 2009, and its disclosure is incorporated herein by reference.

INDUSTRIAL APPLICABILITY

The magnetron and the apparatus that uses microwaves have advantages of improving cooling efficiency of a magnetron by forming a region where cooling fins are sparse and a region where cooling fins are dense when the cooling fins are viewed in a flowing direction of a cooling medium of the magnetron, and are useful as a microwave oven or the like.

The invention claimed is:

1. A magnetron comprising:

an anode tube having permanent magnets at both ends thereof; and a plurality of cooling fins on a periphery of the anode tube, and spaced apart along a central axis of the anode tube at a placement interval, wherein each of the plurality of cooling fins comprises at least two sets of fin portions that comprise cut portions of the cooling fins, each cut portion having different bent sections, respectively, so as to form a dense region intermediate to first and second sparse regions, sequentially located from the central axis when viewed in a flowing direction of a cooling medium that cools the anode tube through the plurality of cooling fins, and wherein the bent sections of at least two sets of fin portions have first, second, and third bending angles, such that intervals of the fin portions in the dense region are spaced apart at a distance that is ½ or less of the placement interval of the cooling fins in the first sparse region.

2. The magnetron according to claim 1, wherein when viewed in the flowing direction of the cooling medium, in the second sparse region, a fin portion of a first set of the at least two sets of fin portions and a part of a fin portion of a second set between the second and third bend angles are on a same plane.

3. The magnetron according to claim 2, wherein when viewed in the flowing direction of the cooling medium, in the dense region, the bent sections are of equal length and a direction of the bent sections of the fin portions of the first set of the at least two sets of fins between the first and second bend angles is opposite from a direction of the bent sections of the fin portions of the second set.

4. An apparatus that uses microwaves comprising a magnetron according to claim 1.

5. The magnetron according to claim 1, wherein at least some of terminal ends of the bent sections at the third bending angle face each other when viewed in the flowing direction of the cooling medium.

6. The magnetron according to claim 1, wherein the bent sections of at least two sets of fin portions have the same length between first and second bend angles.

7. The magnetron according to claim 1, wherein the first, second and third bending angles are parallel to and sequentially located from the central axis and inversely symmetrical with respect to one another.

* * * * *